US007384342B2

(12) United States Patent
Brennan

(10) Patent No.: US 7,384,342 B2
(45) Date of Patent: Jun. 10, 2008

(54) GOLFBALL, A TEAM GOLF GAME SYSTEM AND METHOD OF PLAY

(76) Inventor: Thomas Emmett Brennan, 12953 Grand Traverse Dr., Dade City, FL (US) 33525

( * ) Notice: Subject to any disclaimer, the term of this patent is extended or adjusted under 35 U.S.C. 154(b) by 402 days.

(21) Appl. No.: 10/360,333

(22) Filed: Feb. 10, 2003

(65) Prior Publication Data

US 2004/0157673 A1 Aug. 12, 2004

(51) Int. Cl.
*A63B 67/00* (2006.01)

(52) U.S. Cl. ..... 473/131; 473/409

(58) Field of Classification Search ..... 473/131, 473/409

See application file for complete search history.

(56) References Cited

U.S. PATENT DOCUMENTS

| | | | | |
|---|---|---|---|---|
| 4,266,214 | A * | 5/1981 | Peters, Jr. | 340/323 R |
| 4,911,443 | A | 3/1990 | Foster | |
| 5,507,485 | A * | 4/1996 | Fisher | 473/407 |
| 5,779,566 | A * | 7/1998 | Wilens | 473/407 |
| 6,321,128 | B1 * | 11/2001 | Costin et al. | 700/92 |
| 2003/0144754 | A1 * | 7/2003 | Butts | 700/92 |
| 2003/0163541 | A1 * | 8/2003 | Austin et al. | 709/207 |

OTHER PUBLICATIONS

NCAA News Release. 2000 NCAA Division II Women's Golf Championships Selections. May 8, 2000. http://www.ncaa.org/releases/champselections/2000/2000050803sl.htm.*

USGA. Rules and Decisions. Jan. 1, 2000. http://web.archive.org/20001119191200/www.usga.org/rules/index.html.*

Cadillac Invitational rules of play. 2002. http://cadillacinvitational.com/rules.htm.*

The Ryder Cup History—http://www.rydercup.com/2008/usa/history/.*

Match Format—http://www.rydercup.com/2008/usa/event/match_format.html.*

Ryder Past Results—http://www.rydercup.com/2006/usa/history/past_results.html.*

Page 241 2005-2006 NCAA Division I Manual.

http://golf.about.com/cs/golfterms/a/formatsbets.htm.

Page 11, 2006-2007 Rules of Golf, United States Golf Association.

Page 18, 2006-2007 Rules of Golf, United States Golf Association.

Page 78, 2006-2007 Rules of Golf, United States Golf Association.

Page 131, 2006-2007 Rules of Golf, United States Golf Association.

Page 85, 2006-2007 Rules of Golf, United States Golf Association.

* cited by examiner

*Primary Examiner*—Robert E Pezzuto
*Assistant Examiner*—Damon Pierce

(57) ABSTRACT

Disclosed is "Golfball®", a system and method of playing a team golf game in which teams consisting of nine players each compete in a match play format with the object being to win the greater number of holes, including rules for player substitutions, line up disclosure, simultaneous play, extra holes in case of ties, real time communication of the game score and the number of holes remaining to be played to all participating players and the display of the current status of the game and all component matches on a consolidated scoreboard.

5 Claims, 2 Drawing Sheets

GOLFBALL SCOREBOARD

HOME TEAM: STATE UNIVERSITY — 24

VISITORS: CITY COLLEGE — 23

HOLES TO PLAY: 97

| WINS | HOME PLAYER | 1 | 2 | 3 | 4 | 5 | 6 | 7 | 8 | 9 | MATCH | 10 | 11 | 12 | 13 | 14 | 15 | 16 | 17 | 18 | VISITING PLAYER | WINS |
|---|---|---|---|---|---|---|---|---|---|---|---|---|---|---|---|---|---|---|---|---|---|---|
| 3 | Allen | H | V | 0 | 0 | V | V | H | H | V | 1 | | | | | | | | | | Katz | 4 |
| 2 | Burke | 0 | H | V | 0 | V | V | H | V | 0 | 2 | | | | | | | | | | Lewis | 4 |
| 4 | Clark | | | V | H | H | H | H | V | 0 | 3 | | | | | | | | | | Martin | 2 |
| 3 | Dunn | 0 | V | | H | H | H | V | V | 0 | 4 | | | | | | | | | | Nelson | 3 |
| 2 | Edwards | V | H | | | V | H | V | 0 | V | 5 | | | | | | | | | | Oswald | 4 |
| 3 | Franklin | 0 | H | 0 | | | H | 0 | H | V | 6 | | | | | | | | | | Proctor | 1 |
| 1 | Grant | 0 | | | | | | V | H | V | 7 | | | | | | | | | | Quinlan | 2 |
| 3 | Harrington | H | V | 0 | 0 | 0 | | | H | H | 8 | | | | | | | | | | Roberts | 1 |
| 3 | Innsfield | H | V | H | V | 0 | 0 | | | H | 9 | | | | | | | | | | Sullivan | 2 |

GOLFBALL, A TEAM GOLF GAME SYSTEM AND METHOD OF PLAY

CROSS-REFERENCE TO RELATED APPLICATIONS

Not Applicable.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable.

BACKGROUND OF THE INVENTION

My invention has to do with the game of golf. Golf has been played since the 15th century in Scotland. It was introduced in the United States in the 17th century and became an organized sport in the US in 1888. In early times, golf was played in the format known as match play, in which competitors sought to complete the play of each hole in fewer strokes than their opponents. In recent years, stroke or medal play has become common in professional and collegiate tournaments. In stroke or medal play, the object is to complete the designated number of holes in the least number of strokes.

Despite its immense popularity—golf is played by more than 26 million people in the United States alone—golf has never developed as a team sport. The game is played in many different formats, but there is no single, generally accepted, method of playing golf as a true team game or sport.

By 'true team game or sport' I mean to describe a game or sport in which 1) teams, consisting of more than two players each, compete against each other; 2) the teams compete in a discrete contest or competition, known as a game; 3) there is one accumulating score for each team, the winner being the team with the highest score at the end of the game; 4) the object of the game being that a team defeat an opposing team, the individual success or failure of individual players is not the measure of the winning or losing and consequently substitution of players in accordance with established rules, is permitted; 5) the efforts of the team are coordinated and directed by a coach, manager or captain who is responsible for strategic decision making before and during the game; 6) the players are aware, in substantially real time, of the status of the game, i.e., the current score and the amount of the game remaining to be played, so that their strategy in playing the game can be responsive to the game situation.

To some extent, the Ryder Cup® and Presidents Cup® competitions have approached the model of true team sports. Still, they are not played in a single, discrete game format, but instead are played over a period of several days using different formats each day.

Intercollegiate and interscholastic golf competition is generally conducted in stroke or medal play format which lacks both the cohesiveness and the challenge of match play competition. Moreover, college players typically compete in multi-school tournaments rather than in games against one other school.

Typically, golfers, both professional and amateurs, compete in tournaments rather than games. It is rare for more than a fraction of the players in a golf tournament to be in contention for the winner's prize. The rest of the field presents little spectacle for fans to watch or care much about. Golf enthusiasts are familiar with the structure known as the 'Leaderboard', a large display showing the progress of the ten or twelve players currently leading a golf tournament. Even there, I have found no evidence of electric leaderboards which might rival the animated and exciting scoreboards used in football, baseball, basketball, and hockey. This is partially because the identity of the leaders is subject to change. It is also true that most golf tournaments do not present the kind of fast action that lends itself to automated scoreboards.

To the extent that golf tournaments represent the prior art related to team golf competition, there are a number of shortcomings which my invention is intended to address. Unlike sports which are played in stadiums and arenas, golf is played on a golf course which may occupy 150 to 200 acres or more. The players are not within sight and sound of each other. Various means of keeping players informed of the status of the game are unsatisfactory. Often, even professional golfers engaged in major tournaments are only peripherally aware of the overall status of the event because of hearing crowd reactions on adjacent holes. An effective course-wide public address system is not only expensive; its intrusive noise would be disrupting to players. The same is true to a lesser degree of walkie-talkies. To maintain manually posted scoreboards all over a golf course would be very expensive.

While it is true that in major golf tournaments something approaching real time, overall score keeping is accomplished through telephonic and other electronic voice communication with the leaderboard, such labor intensive and costly score keeping is not available to amateur, recreational, high school, or even collegiate golfers.

U.S. Pat. No. 4,266,214 issued to Joseph Peters, Jr., describes a hand held game scoring apparatus, not unlike the Golfball® scorecard included in my invention. Peters, however, does not address the problem of communicating the current score of a golf game to the several participants who are scattered over the golf course. Moreover, the Peters device is multi-purpose, requires a certain amount of initial data input, (course information, handicaps, etc), and does not function either as a transmitter or receiver of information. Nor does it have as its primary purpose, the function of keeping players informed of the status of the game over the entire field of play.

BRIEF SUMMARY OF THE INVENTION

The Golfball® game is a team golf game, played according to the rules of match play competition substantially as used in American golf (eg., USGA®), as modified by the Golfball® rules. There are nine players on a team. They compete in nine individual matches. The score of the game is the total number of holes won by each team. Thus, each of the nine matches continues for the full 18 holes of the golf course. There are 162 holes in all to be played. No points are awarded for holes that are halved or tied. If the score is tied after the full 18 holes of play, an additional overtime hole is played by all nine matches. If the score is still tied after play of the 19th hole, a 20th hole is played and play continues in like fashion until a winner is determined.

Substitutions are allowed. A player may be removed from the game before teeing off on any given hole. If a player is removed from the game, he or she may not return to the game during the same period, half or nine. Extra holes played because of a tie in the regulation game are considered as a separate, third period for the purpose of the substitution rule.

In its preferred embodiment, Golfball® is commenced with a shotgun, or simultaneous start, in which the nine players of each team are assigned to the first nine holes of the golf course. Thereupon, playing in twosomes, they rotate around the front nine of the golf course until each twosome has played nine holes, being 81 holes in all. Then there is an intermission, or halftime. After the intermission, play resumes with a similar shotgun or simultaneous start on the back nine of the golf course.

Prior to the beginning of the game, the coach, manager or captain of the home team must present his line up for the front nine and the coach, manager or captain of the visiting team must present his line up for the back nine, thereby permitting the opposing coach, manager or captain to determine which of his or her players will be matched up to compete against which opposing player. If extra holes are to be played because of a tie in the regulation game the match ups in place at the end of the regulation game will continue.

An important component of my invention is the use of the Golfball® scorecard and the Golfball® scoreboard. Since the Golfball® scorecard is essentially a hand held score keeping device, there are, in fact, patents issued on similar devices, some of which may be capable of doing at least some of what the Golfball® scorecard does. In fact, existing hand held golf scoring devices typically do much more complicated score keeping than the Golfball® scorecard, and their very sophistication distinguishes them and makes them less than useful in the present application.

The Golfball® scorecard is a very simple, hand held apparatus which requires no special training or aptitude to operate. Players are identified as either the home team or the visiting team. The only thing a player has to do is activate one of three keys after the play of each hole, either the key designating the home team player as the winner of the hole, or the key designating the visiting team player as the winner of the hole, or a third key designating that the hole was tied.

The Golfball® scorecard acts as a transmitter of the data input by the players and sends the information to the Golfball® scoreboard, which in turn calculates the new game score and game status, and relays that information out to all nine Golfball® scorecards, so that all of the players can be aware of the status of the game in real time.

The Golfball® scoreboard is a larger apparatus than the Golfball® scorecard. It may be a computer which may or may not be connected to a projector. The Golfball® scoreboard has the means of inputting, retaining, and printing out data with respect to the game, including, but not limited to, the name of the golf course, the date of the game, the names of the respective home and visiting teams, the names of the players and the holes to which they are assigned at the beginning of each period.

DETAILED DESCRIPTION OF THE INVENTION

Golfball® is a system and method of playing a team golf game. It consists of a set of rules which incorporate the rules of match play substantially as used in American golf (eg., USGA®), adding the following specific variations:

1) A team consisting of nine players who compete against another team consisting of nine players.

2) A single game score consisting of the total number of holes won by each team.

3) The object of the game being to win more holes than the opposing team,

4) A shot gun, or simultaneous start on the front nine of the golf course.

5) An intermission after the play of nine holes.

6) A second shotgun or simultaneous start on the back nine of the golf course.

7) An extra-hole protocol continuing all nine matches in case of a tie after play of the first 18 holes.

8) A system for assigning players to the several holes creating match ups between players of the respective home and visiting teams.

9) A rule allowing for the substitution of players whereby a player may be removed from the game prior to teeing off on any given hole, and a new player substituted.

10) A rule preventing platooning by prohibiting a player removed from the game to return to the game until the next period of play.

11) A system of score keeping whereby the result of play on every hole is communicated to a central scoreboard.

12) A system of score keeping whereby the score of the game is recalculated as each hole is played, displayed on a single consolidated scoreboard and the current score of the game transmitted to all of the players on the golf course.

Figure 1:
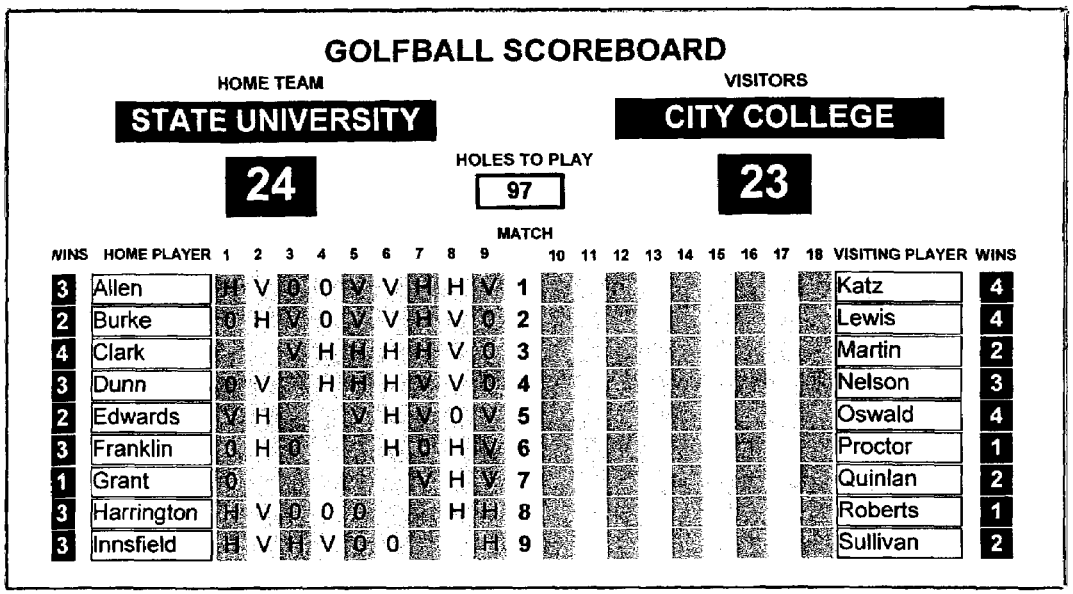
FIG. 1 depicts the Golfball® scoreboard, showing the names of the respective home and visiting teams, the names of the players, the score of the game, the number of holes remaining to be played in the regulation game, the score of each individual match, and the result on each hole; whether won by the home or visiting player or tied.

FIG. 1 depicts the Golfball® scoreboard, which may be displayed on a desk top or lap top computer, projected onto a screen or wall, or embodied in a dedicated apparatus or structure of any size. The Golfball® scoreboard displays the name of the home team, in FIG. 1 shown as "State University". It displays the name of the visiting team, shown in FIG. 1 as "City College". The Golfball® scoreboard displays the current score of the home team directly beneath the name of the home team, shown in FIG. 1 as "24". It displays the current score of the visiting team directly beneath the name of the visiting team, shown in FIG. 1 as "23". The Golfball® scoreboard also displays the number of holes remaining to be played in the regulation game in the center of the scoreboard and between the scores of the respective teams, shown in FIG. 1 as "97". The Golfball® scoreboard displays the numbers of the several individual matches in a vertical column in the center of the scoreboard under the heading "Match", shown in FIG. 1 by the consecutive numerals "1" through "9".

The Golfball® scoreboard identifies the 18 holes of the golf course shown in FIG. 1 as the numerals "1" through "18" arranged horizontally beneath the displays of the team scores. The Golfball® scoreboard displays the names of the players in the first match in the first horizontal row beneath the hole numbers, shown in FIG. 1 as "Allen" being the home team player, and "Katz" being the visiting team player. The current status of the first match is displayed in the first row, with the number of holes won by the home team player appearing immediately to the left of the home team player's name, shown in FIG. 1 as the numeral "3" to the left of the player "Allen", and the number of holes won by the visiting team player appearing immediately to the right of the name of the visiting team player, shown in FIG. 1 as the numeral "4" to the right of the player "Katz". The cumulative results of the first match are displayed in the first row of spaces beneath the hole numbers, with the letter "H" indicating that the home team player won the hole, the letter "V" indicating that the visiting team player won the hole and the numeral "0" indicating that the hole was halved or tied.

The Golfball® scoreboard displays the names of the players in the second match in the second horizontal row beneath the hole numbers, shown in FIG. 1 as "Burke" being the home team player, and "Lewis" being the visiting team player. The current status of the second match is displayed in the second row, with the number of holes won by the home team player appearing immediately to the left of the home team player's name, shown in FIG. 1 as the numeral "2" to the left of the player "Burke", and the number of holes won by the visiting team player appearing immediately to the right of the name of the visiting team player, shown in FIG. 1 as the numeral "4" to the right of the player "Lewis". The cumulative results of the second match are displayed in the second row of spaces beneath the hole numbers, with the letter "H" indicating that the home team player won the hole, the letter "V" indicating that the visiting team player won the hole and the numeral "0" indicating that the hole was halved or tied.

The Golfball® scoreboard displays the names of the players in the third match in the third horizontal row beneath the hole numbers, shown in FIG. 1 as "Clark" being the home team player, and "Martin" being the visiting team player. The current status of the third match is displayed in the third row, with the number of holes won by the home team player appearing immediately to the left of the home team player's name, shown in FIG. 1 as the numeral "4" to the left of the player "Clark", and the number of holes won by the visiting team player appearing immediately to the right of the name of the visiting team player, shown in FIG. 1 as the numeral "2" to the right of the player "Martin". The cumulative results of the third match are displayed in the third row of spaces beneath the hole numbers, with the letter "H" indicating that the home team player won the hole, the letter "V" indicating that the visiting team player won the hole and the numeral "0" indicating that the hole was halved or tied.

The Golfball® scoreboard displays the names of the players in the fourth match in the fourth horizontal row beneath the hole numbers, shown in FIG. 1 as "Dunn" being the home team player, and "Nelson" being the visiting team player. The current status of the fourth match is displayed in the fourth row, with the number of holes won by the home team player appearing immediately to the left of the home team player's name, shown in FIG. 1 as the numeral "3" to the left of the player "Dunn", and the number of holes won by the visiting team player appearing immediately to the right of the name of the visiting team player, shown in FIG. 1 as the numeral "3" to the right of the player "Nelson". The cumulative results of the fourth match are displayed in the fourth row of spaces beneath the hole numbers, with the letter "H" indicating that the home team player won the hole, the letter "V" indicating that the visiting team player won the hole and the numeral "0" indicating that the hole was halved or tied.

The Golfball® scoreboard displays the names of the players in the fifth match in the fifth horizontal row beneath the hole numbers, shown in FIG. 1 as "Edwards" being the home team player, and "Oswald" being the visiting team player. The current status of the fifth match is displayed in the fifth row, with the number of holes won by the home team player appearing immediately to the left of the home team player's name, shown in FIG. 1 as the numeral "2" to the left of the player "Edwards", and the number of holes won by the visiting team player appearing immediately to the right of the name of the visiting team player, shown in FIG. 1 as the numeral "4" to the right of the player "Oswald". The cumulative results of the fifth match are displayed in the fifth row of spaces beneath the hole numbers, with the letter "H" indicating that the home team player won the hole, the letter "V" indicating that the visiting team player won the hole and the numeral "0" indicating that the hole was halved or tied.

The Golfball® scoreboard displays the names of the players in the sixth match in the sixth horizontal row beneath the hole numbers, shown in FIG. 1 as "Franklin" being the home team player, and "Proctor" being the visiting team player. The current status of the sixth match is displayed in the sixth row, with the number of holes won by the home team player appearing immediately to the left of the home team player's name, shown in FIG. 1 as the numeral "3" to the left of the player "Franklin", and the number of holes won by the visiting team player appearing immediately to the right of the name of the visiting team player, shown in FIG. 1 as the numeral "1" to the right of the player "Proctor".

The cumulative results of the sixth match are displayed in the sixth row of spaces beneath the hole numbers, with the letter "H" indicating that the home team player won the hole, the letter "V" indicating that the visiting team player won the hole and the numeral "0" indicating that the hole was halved or tied.

The Golfball® scoreboard displays the names of the players in the seventh match in the seventh horizontal row beneath the hole numbers, shown in FIG. 1 as "Grant" being the home team player, and "Quinlan" being the visiting team player. The current status of the seventh match is displayed in the seventh row, with the number of holes won by the home team player appearing immediately to the left of the home team player's name, shown in FIG. 1 as the numeral "1" to the left of the player "Grant", and the number of holes won by the visiting team player appearing immediately to the right of the name of the visiting team player, shown in FIG. 1 as the numeral "2" to the right of the player "Quinlan". The cumulative results of the seventh match are displayed in the seventh row of spaces beneath the hole numbers, with the letter "H" indicating that the home team player won the hole, the letter "V" indicating that the visiting team player won the hole and the numeral "0" indicating that the hole was halved or tied.

The Golfball® scoreboard displays the names of the players in the eighth match in the eighth horizontal row beneath the hole numbers, shown in FIG. 1 as "Harrington" being the home team player, and "Roberts" being the visiting team player. The current status of the eighth match is displayed in the eighth row, with the number of holes won by the home team player appearing immediately to the left of the home team player's name, shown in FIG. 1 as the numeral "3" to the left of the player "Harrington", and the number of holes won by the visiting team player appearing immediately to the right of the name of the visiting team player, shown in FIG. 1 as the numeral "1" to the right of the player "Roberts". The cumulative results of the eighth match are displayed in the eighth row of spaces beneath the hole numbers, with the letter "H" indicating that the home team player won the hole, the letter "V" indicating that the visiting team player won the hole and the numeral "0" indicating that the hole was halved or tied.

The Golfball® scoreboard displays the names of the players in the ninth match in the ninth horizontal row beneath the hole numbers, shown in FIG. 1 as "Innsfield" being the home team player, and "Sullivan" being the visiting team player. The current status of the ninth match is displayed in the ninth row, with the number of holes won by the home team player appearing immediately to the left of the home team player's name, shown in FIG. 1 as the numeral "3" to the left of the player "Innsfield", and the number of holes won by the visiting team player appearing immediately to the right of the name of the visiting team player, shown in FIG. 1 as the numeral "2" to the right of the player "Sullivan". The cumulative results of the ninth match are displayed in the ninth row of spaces beneath the hole numbers, with the letter "H" indicating that the home team player won the hole, the letter "V" indicating that the visiting team player won the hole and the numeral "0" indicating that the hole was halved or tied.

Figure 2:
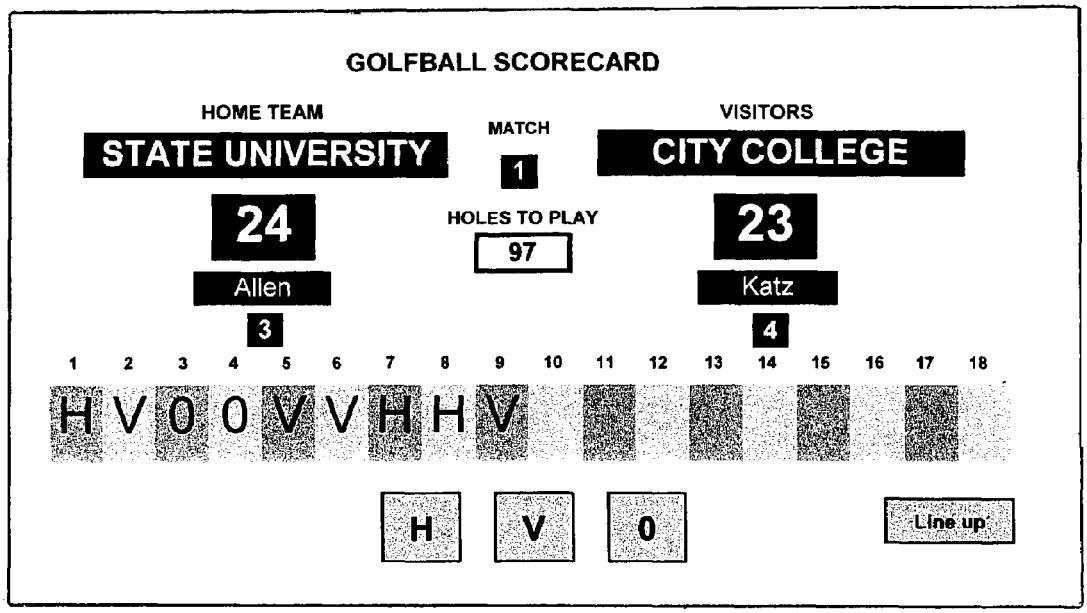
FIG. 2 depicts the Golfball® scorecard, showing the names of the respective home and visiting teams, the score of the game, the number of holes remaining to be played, the number of the particular match being scored, the names of the players in this match, the number of holes won by each player in this match, and the result of each hole played by them, whether won by the home team player, or the visiting team player or tied by them. The drawing also shows the three input keys for home win, visitor win and tie, as well as a line up key permitting access to the Golfball® scoreboard.

FIG. 2 depicts the Golfball® scorecard, which in the preferred embodiment, would be a hand held apparatus which displays the name of the home team, shown in FIG. 2 as "State University", the name of the visiting team, shown in FIG. 2 as "City College"; the number of the match being scored, shown in FIG. 2 as the numeral "1" appearing between the names of the teams, the name of the home team player in the match being scored, shown in FIG. 2 as "Allen"; the name of the visiting team player in the match being scored, shown in FIG. 2 as "Katz"; the current score of the home team, shown in FIG. 2 as the number "24" appearing beneath the name of the home team; the current score of the visiting team, shown in FIG. 2 as the number "23" beneath the name of the visiting team; the number of holes remaining to be played, shown in FIG. 2 as the number "97" appearing between the scores of the two teams; the name of the home team player competing in the match being scored, shown in FIG. 2 as the name "Allen" appearing immediately beneath the score of the home team; the name of the visiting team player in the match being scored, shown in FIG. 2 as the name "Katz" appearing immediately beneath the score of the visiting team; the number of holes won by the home team player, shown in FIG. 2 as the numeral "3" appearing immediately beneath the name of the home team player; the number of holes won by the visiting team player, shown in FIG. 2 as the number "4" appearing immediately beneath the name of the visiting team player; and the cumulative results of the match on each of the holes which have been played, shown in FIG. 2 by the letters "H" and "V" and the numeral "0" in the spaces beneath the numbers "1" through "18", being the designation of the 18 holes of the golf course.

What is claimed is:

1. A method of playing a game called "golfball" comprising the steps of: (a) providing a playing field having teeing grounds, fairways, and greens and consisting of nine or eighteen holes maintained as in the game of golf; (b) providing golf balls and golf clubs as used in the game of golf; (c) providing rules of match play as used in the game of golf; (d) providing two teams, each consisting of multiple players having as their object to win the greater aggregate number of holes by striking the ball into the hole using fewer strokes than their opponents; (e) providing simultaneous matches comprised of one player from each team having as his or her objective to win holes by striking the ball into the hole using fewer strokes than his or her opponent; (f) providing a simultaneous or shot gun start by which the several players of each team are individually assigned to begin play on different holes of the golf course; (g) providing a rule that after nine holes have been played, an intermission shall occur, after which a second simultaneous or shot gun start shall occur to begin the second half of the game; (i) providing a rule permitting the substitution of a new player to replace a player before he or she has struck a ball from the teeing ground on a given hole, and prohibiting the return of a player so removed from the game during the same nine, period or half; (j) providing a rule requiring the manager or captain of the home team to present a line up showing the assignment of home team players to the several holes of the front nine before the beginning of the game and permitting the manager or captain of the visiting team to designate which visiting player shall compete against which home team player at the start of the game; (k) providing a rule requiring the manager or captain of the visiting team to present a line up showing the assignment of visiting team players to the several holes of the back nine before the beginning of the game and permitting the manager or captain of the home team to designate which home team player shall compete against which visiting team player at the start of the second nine, half or period; (l) providing the communication of the results of the competition in each match on each hole to a central location at which a general scoreboard is maintained; (m) providing the calculation of the score of the game by combining the results of each match on each hole such that a total or aggregate score for each team is compiled; (n) providing the calculation of the holes remaining to be played by deducting the sum of the total number of holes won by each team and the total number of holes tied from a number calculated by multiplying the number of matches by 18; (o) providing the communication to each player of the current score of the game and the current number of holes to be played.

2. A method of playing a game called golfball as set forth in claim 1 including the step of providing a device known as a golfball scorecard, consisting of a mechanical or electronic unit or device designed to record and display the number of holes won by each player in a particular match, and having a means to display the current score of the golfball game and the number of holes remaining to be played in the golfball game.

3. A method of playing a game called golfball as set forth in claim 2 including a step of providing a device known as a golfball scorecard having a means of communicating the information displayed on the scorecard regarding a particular match to a general scoreboard.

4. A method of playing a game called golfball as set forth in claim 3 including the step of providing a device known as a golfball scoreboard which receives the reports of the results of the various holes from each of the golfball scorecards being used by the players, calculates the total number of holes won by each team and the number of holes remaining to be played, and communicates this information back to the golfball scorecards.

5. A method of playing a game called golfball as set forth in claim 4 including a step of providing an electronic device called a golfball scoreboard having a means of recording and displaying the date of the game, the name and location of the golf course on which the game is being played, the names of the two teams playing the game and their respective designations as the home team and the visiting team, the names of the players on each team and the holes on which they are assigned to begin play.

* * * * *